United States Patent [19]

Beard

[11] Patent Number: 4,469,253

[45] Date of Patent: Sep. 4, 1984

[54] RECLOSABLE VALVE WITH REMOVABLE HERMETIC EXTERNAL SEAL MEANS

[76] Inventor: Walter C. Beard, South St., Middlebury, Conn. 06762

[21] Appl. No.: 476,782

[22] Filed: Mar. 25, 1983

Related U.S. Application Data

[63] Continuation-in-part of Ser. No. 452,953, Dec. 27, 1982.

[51] Int. Cl.[3] ..... B65D 83/14

[52] U.S. Cl. ..... 222/153; 222/182; 222/402.12; 215/250; 215/254; 220/276; 220/284

[58] Field of Search ..... 222/153, 182, 541, 542, 222/562, 402.1, 402.12; 220/85 P, 214, 276, 284, 270, 250; 215/254, 255, 256

[56] References Cited

U.S. PATENT DOCUMENTS

| | | | |
|---|---|---|---|
| 2,709,111 | 5/1955 | Green . | |
| 2,731,298 | 1/1956 | Green . | |
| 2,737,416 | 3/1956 | Behr et al. . | |
| 2,947,451 | 8/1960 | Suellentrop . | |
| 3,022,922 | 2/1962 | Patton et al. | 222/182 |
| 3,048,307 | 8/1962 | Michel . | |
| 3,156,942 | 11/1964 | Nyden . | |
| 3,161,331 | 12/1964 | Murtha | 222/394 |
| 3,162,329 | 12/1964 | Gregory . | |
| 3,170,603 | 2/1965 | Kitterman . | |
| 3,179,313 | 4/1965 | De Malglaive . | |
| 3,180,532 | 4/1965 | Michel . | |
| 3,233,788 | 2/1966 | Diamond . | |
| 3,266,676 | 8/1966 | McKernan . | |
| 3,266,910 | 8/1966 | Barnby | 222/562 X |
| 3,334,769 | 8/1967 | Gach . | |
| 3,378,172 | 4/1968 | Nelson | 222/182 X |
| 3,439,830 | 4/1969 | Hendrickson et al. | 222/182 X |
| 3,506,241 | 4/1970 | Ewald | 251/354 |
| 3,514,011 | 5/1970 | Madeira et al. . | |
| 3,565,295 | 2/1971 | Doyle . | |
| 3,729,116 | 4/1973 | Green et al. . | |
| 3,791,551 | 2/1974 | Madeira . | |

FOREIGN PATENT DOCUMENTS

| | | | |
|---|---|---|---|
| 1445202 | 8/1976 | United Kingdom | 222/402.12 |

*Primary Examiner*—Joseph J. Rolla

*Attorney, Agent, or Firm*—Hill, Van Santen, Steadman & Simpson

[57] ABSTRACT

A reclosable valve stem actuated valve structure for aerosol-type containers and the like which valve structure is provided with a preassembled but removable external seal. The seal includes a seal member, bonding agent, and a rupturable frangible zone. The valve structure can be associated with an aerosol-type container without interference from the seal and the seal can be opened before the interveningly filled valve-equipped container is used.

16 Claims, 8 Drawing Figures

RECLOSABLE VALVE WITH REMOVABLE HERMETIC EXTERNAL SEAL MEANS

RELATED APPLICATION

This application is a continuation-in-part of my earlier filed U.S. patent application Ser. No. 452,953, filed Dec. 27, 1982.

BACKGROUND OF THE INVENTION

1. Field of the Invention

This invention lies in the field of valves actuated by stem movements and particularly to combination of such valves with preassemblable independent removable hermetic external seal means.

2. Description of the Prior Art

In the art of the aerosol-type valves, it is common for a reclosable valve assembly to be operated during opening and closing by means of the movement of the valve stem through application thereto of an appropriately applied external force, as from an operator's finger. Typically during operation, such a valve stem is moved or displaced (e.g., tilted or reciprocated) relative to its normally upright closed (typically axially aligned) position.

Especially when the fill of a pressurized container that is functionally associated with such a valve assembly (as the dispensing means) is sensitive to, or reactive with oxygen, water vapor, or other substances found in the atmospheric environment, it would be desirable, and for certain fills actually necessary, to seal externally and hermetically the valve assembly (relative to the fill in the container) until such time as the fill is to be dispensed and used. Further, when, for example, a bottom filled container is desired to be associated functionally with an externally hermetically sealed preassembled valve assembly wherein such seal is removable before fill dispensing, it would be necessary to employ a valve assembly which can be preassembled with the external seal in place, thereby to avoid associating an external seal with a valve assembly after the valve assembly is installed on its container. Thereafter, when a fill is being dispensed, such hermetic seal is opened (ruptured) permanently by means externally applied force after which the reclosable valve assembly can be opened and closed in typical (normal) fashion for dispensing the fill. Optionally, the external seal may be mechanically reassociated with the valve assembly to provide protection of the valve assembly against exteriorly originating bumps, etc.

In the prior art, a variety of externally used valve protective cover means have been employed to adjoin mechanically a protective member with a valve body. Such mechanical means have generally involved snap or force fits, screw-on arrangements, frictional fits, and like mechanical association. For example, one class of such protective cover means comprises so-called tamperproof closures. So far as can be presently determined, in such prior art, there are no true teachings or suggestions of using a separate bonding means to secure a protective cover over a valve for the purpose of providing a hermetic seal over and about the valve components, with which the protective cover and the bonding means are in gas-tight association.

One prior art teaching (Gach U.S. Pat. No. 3,334,769) wherein an external plastic cap is bonded by a layer of adhesive to the dispensing container over the valve assembly. This cap is only installable after the valve assembly is mounted (crimped) on the dispensing container. The cap cannot be installed on the valve assembly prior to the installation of the valve assembly on the container so that in a container/valve assembly composite assembly operation an extra step is required to install the cap on the composite. For reasons of manufacturing cost and convenience, it is cheaper and more efficient to preassemble an external seal with a valve assembly before the valve assembly is assembled with a container. Moreover, the sole function of the Gach cap is to prevent pilfering or the like and no teaching of a true hermetic seal is provided.

There is a need in the aerosol valve trade for an aerosol container manufacture to be able to buy his supplies of containers and valve assemblies in respective preassembled conditions, as those skilled in the art appreciate.

Thus, so far as is now known, reclosable valve assemblies of the type operatable by valve stem movement have not previously been known which were provided with removable external hermetic seal means wherein a seal means is bonded in a gas-tight manner to a valve body and wherein the seal means is preassemblable with the valve assembly before the complete valve assembly is assembled with a container to form the desired composite structure.

Previously, I have invented a class of reclosable valves operated by valve stem tilting which are provided with an external reclosable valve stem tip seal which is operated by valve stem tilting. This tip seal forms a second seal which protected material possibly retained in the stem from atmospheric action associated with valve stem tilting in a previous use; see Beard U.S. patent application Ser. No. 394,517, filed July 2, 1982, now U.S. Pat. No. 4,418,847. However, because this tip seal is operated through the existence of an internal force, it does not provide a hermetic seal of the class presently provided.

BRIEF SUMMARY OF THE INVENTION

By the present invention, there is provided a stem equipped, reclosable valve assembly of the type operated by a valve stem which moves relative to a valve body, such valve assembly being provided with an initially integrally associated external sealing member, a bonding means, a frangible zone, and an optional or auxilliary frangible zone opening means associated with the sealing member. Such sealing member is so constructed, and associated with the valve assembly, that such member does not interfere with the mountability of the valve assembly with the container to which it is to be assembled.

The external sealing means is gas impermeable and a portion thereof is initially secured to a portion of such valve body (which body itself it also gas impermeable) by the bonding means which is likewise gas impermeable and which thus secures and maintains such sealing member in a gas-tight relationship with such valve body. The frangible zone is located in (a) such external sealing member, (b) such bonding means, and/or (c) some adjacent region therebetween, and the frangible zone extends along a closed pathway which generally circumscribes a region around the valve stem.

If a frangible zone opening means is employed, such can comprise a tab means that is associated with such external sealing means through which an externally applied force is locally exertable against such sealing member in a region thereof preferably adjacent such frangible zone. When such localized force is sufficiently great. a localized breaking or separation is initiated in such frangible zone, and then is continued, thereby permitting the external sealing member to be removed (separated) in the region of the closed pathway defined by the frangible zone, and thereby opening such sealing member at least in the region of the valve stem and permitting a pressurized fill to be dispensable from the container through the valve stem functionally associated with such valve assembly during normal valve assembly opening operations.

The present invention provides, in one aspect, a significant advance in the art of aerosol-type valves by providing a capacity for long shelf-life storage of container fills sensitive to atmospheric gases (including moisture) through the provision of an externally openable hermetic external seal means functionally associated with the body of such a valve.

In another aspect, the present invention provides a reclosable valve assembly which, after a preassemblable external hermetic seal in functional association therewith is opened, can be opened and closed at will by a valve user.

In another aspect, this invention provides a reclosable valve structure for pressurizable containers and the like which valve structure incorporates initially a preassemblable openable hermetic external seal means and an optional associated externally operated external seal removing means, and which valve structure can be preassembled, then bulk stored with other such structures in a common container, and next mounted on such a container as by crimping a valve cup to a container mouth, followed by a container fill charging, generally without any substantial danger to the sealing integrity of such external seal means and to such external seal removing means.

In another aspect, the present invention provides a preassemblable initially externally hermetically sealed, stem-actuated, pressurizable valve assembly which can be intentionally unsealed before valve use and which is characterized by substantial freedom from the possibility of inadvertent or premature unsealing caused by vibration, shock, aging, or the like, particularly when the valve assembly is in functional association with a container that has been charged with a pressurized fill.

In another aspect, the present invention provides a stem-operated valve assembly with a preassemblable external hermetic sealing member and a bonding means for such sealing member, such combination being unsealable by rupturing or breaking either such bonding means or such sealing member, such combination being unsealable by rupturing or breaking either such bonding means or such sealing member through the application thereto of localized externally applied force.

In another aspect, the present invention provides a stem-equipped valve assembly with a preassemblable external hermetic sealing means involving a combination of (a) a sealing member comprised of sheet metal and having a coined closed pathway defined about a central portion thereof, (b) a tab means associated with said sealing member and adapted to permit application of localized force thereto at a location along such coined pathway, and (c) bonding means securing edge portions of such sealing member to a body portion of such valve assembly in a gas-tight relationship.

In another aspect, the present invention provides a reclosable valve with a separate preassemblable external hermetic seal means and external seal opening means therefor which valve is optionally characterized by a capacity for very large flow therethrough after the external seal means is removed by use of such external seal opening means and the valve is opened.

In another aspect, the present invention provides a reclosable valve with both a separate preassemblable removable external hermetic seal means and a removable internal seal means, the valve structure further being provided with integrally incorporated internal seal removing means, such reclosable valve being provided with a moveable valve stem member.

Other and further aspects, aims, objects, features, advantages, embodiments, uses, and the like will be apparent to those skilled in the art from the present specification.

DETAILED DESCRIPTION

Figure 1:
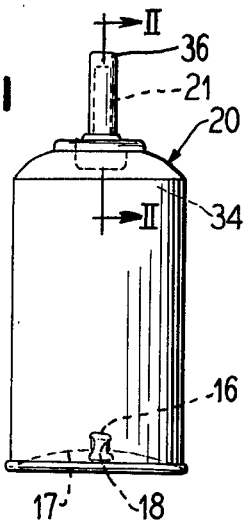
FIG. 1 is a view of an aerosol-type container associated functionally with one embodiment of a valve assembly of the present invention.
Figure 2:
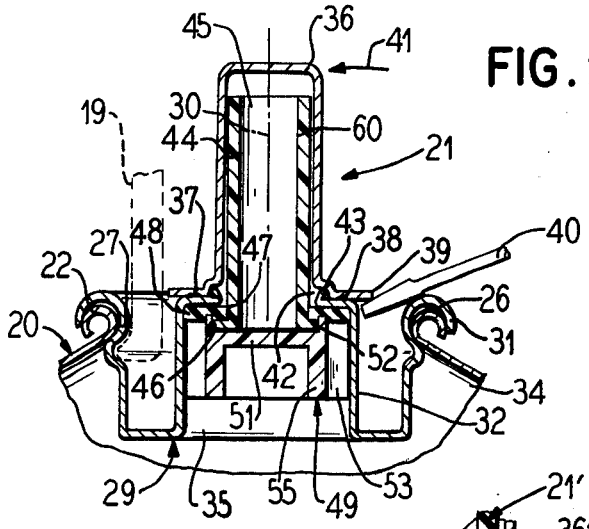
FIG. 2 is an enlarged vertical sectional view taken along the line II—II of FIG. 1.

Referring to FIGS. 1 and 2, a dispensing container or can 20 is fitted on its top end with a tilt valve structure 21 of the present invention. Container 20 is provided with an axially located aperture 27 having a rolled perimeter 22, container 20 being formed in this instance of sheet metal.

Container 20 is of conventional construction and includes a bottom plate with a plugable aperture for filling and pressuring purposes, as those skilled in the art will appreciate. Any suitable arrangement of container components can be employed with a valve structure of this invention.

The tilt valve structure 21 includes a metallic mounting cup or valve body 29 which terminates in a rolled perimeter 31 that is adapted to make nesting engagement with the rolled perimeter 22. Interior surfaces of the roll 31 are provided with a coating 26 formed of a sealing material of resilient, elastomeric plastic composition, such as chloroprene rubber composition, or the like, so that, when the mounting cup 29 is fitted over the rolled perimeter 22 and formed by collet fingers 19 (see FIG. 2), there is produced a retaining crimp 33 in cup 29, and the preformed valve structure 21 is thus sealingly associated with the container 20. Charging of container 20 with a pressurized fill is conventionally accomplished through aperture 18 in bottom plate 17 which is thereafter sealed by plug 16, as those skilled in the art will readily appreciate.

The valve structure 21, as those skilled in the art will also readily appreciate, is suitable for the dispensing of a viscous fluid which may have admixed therewith a gaseous propellent. When pressurized fluid material in the chamber 34 can react with oxygen water vapor, or other substance in the atmosphere, or when such material can react with components of the valve structure 21 housed in the central cavity portion 35 of the cup 29, a storage stability problem may arise particularly when the assembly of valve structure 21 and container 20 is to be stored for an extended period of time before use.

To overcome this problem, a seal 36 is positioned across the upper or exterior flanged central portions 37 of mounting cup 29 and such seal 36 is adhered to such flanged central portions 37 by bonding means 38 such as an adhesive, or the like. The seal 36 and the bonding means 38 are each gas tight so as to provide in combination with central portions 37 or cup 29 a hermetic seal. The rim of the seal 36 may be provided with a projection 39 which, in this instance, extends circumferentially therearound. The bonding means 38, however, provides a releasable or separatable frangible zone serving to permit separation, in response to an appropriate force applied to projection 39, of the seal 36 from the central portions 37 so that the seal 36 is parted from its initial adjacent gas-tight association with the central portions 37 in the assembled valve structure 21. The force so applied to projection 39 can be provided by any convenient prying means, such as a screw driver 40 shown fragmentarily in FIG. 2, or the like. Alternatively, the force can be provided by applying an external tilting force in the direction of arrow 41 near the uppermost central portion of the seal 36. The separation thus occurs in a frangible zone defined by a fracture in the bonding means 28 itself, or by a breaking away of the bonding means 38 from one or the other of the seal 36 or the central portions 37, or by some combination thereof, or otherwise, as desired. Such separation is accomplished at the time when the valve structure 21 is to be first used for the dispensing of pressurized material from chamber 34 of container 20.

The releasable bonding means 38, in general, can be provided by any convenient or suitable composition, the exact choice in any given instance being influenced by cost factors, functional requirements of a particular seal construction application, and the like. When the seal 36 is formed, for example, of sheet metal, the releaseable bonding means 38 can be comprised of, for examples, (a) a nonmetallic adhesive which is organic or inorganic in composition, (b) a metallic bond, such as a hairline weld, soldered joint, or the like, or even (c) some combination of the foregoing, or the like, as desired.

In general, the seal 36 can be comprised of any convenient solid gas impermeable material which will suitably withstand the pressures within the chamber 34 and which will not rupture or crack during normal storage of a filled and pressured container 20. A presently preferred construction material for a seal member 36 is sheet metal, such as steel, or the like.

Care needs to be exercised to be sure that gas-tight sealing is obtained between the bonding means 38, seal 36, and central flanged portion 37. Additionally, care needs to be exercised in the positioning, sizing, structure, and bonding strength developed between the seal 36, central flanged portion 37, and bonding means 38 so that a desired release or rupture in the region of the frangible zone can be achieved through the type of desired applied opening force employed.

When, for example, the cup 29 and the seal 36 are comprised of steel, the bonding means 38 can be, for example, one derived from: (a) a thermoplastic adhesive film (such as "Scotchweld" film 1460 from 3M Co., St. Paul, Minn. presently preferred; or dry film T-1502, which is presently understood to be a polyester film coated with a thermoplastic adhesive, from Sheldahl Co., Northfield, Minn. or the like); (b) a thermosetting film (such as dry film T-1401, which is understood to be a thermosetting adhesive from Sheldahl Co.), so-called instant bonding, initially liquid adhesives (such as so-called anaerobic adhesive like "Loctite Superbonder" 43; of "Loctite" 242 adhesive sealant from Loctite Corporation, Newington, Conn. or a cyanoacylate type adhesive such as is available from, for example, Eastman Chemical Co. of Rochester, N.Y.; or the like); (c) a hot melt adhesive (such as "Darex" side seam cement No. HMP-8306 from W. R. Grace & Co., Dewey and Almy Chemicals Division, Atlanta, Ga., which is an initially solid material that is melted at about 360° F. and applied as a liquid to at least one of the two surfaces to be bonded together; and the like); and the like. When using an adhesive film, it is presently preferred to prepare a laminate-type assembly of the two components to be bonded together after which an exposed metal surface of one of the components is spot heated, or the like, by a localized heat source to a temperature at least sufficient to effectuate a bonding of metal-to-firm-to-metal. A valve 21 is generally preassembled before being associated with a container 20.

As those skilled in the art will appreciate, the internal diameter of the aperture 27 defined by the rolled perimeter 22 can be standardized in the valve trade while the mounting cup 29 is so formed as to have an inner wall member 32 integrally formed with the central flanged portion 37 which wall member 32 can have a diameter and an axial length as particularly chosen for an individual type of valve structure 21 desired.

Through the center of flanged portion 37 and along the axis 30 of the mounting cup 29 is an aperture 42 which can be optionally provided, as in valve assembly 21, with an upstanding lip 43 which serves as a stiffening or reinforcing means about the aperture 42. Through the aperture 42 is extended a nozzle stem member 44 which, at its upper end portion, is provided with a dispensing orifice 45, and which, at its opposite input end portion, is provided with a radially outwardly extending flange 46 that is here integrally formed with the nozzle stem member 44. The nozzle stem member 44 extends also through a central aperture 47 of a resilient elastomeric gasket 48 which gasket 48 also makes abutting contact with both adjacent outer wall portions of the nozzle stem member 44 and the flange 46. The outer perimeter of the gasket 48 is seated in the inner wall member 32 adjacent the central portion 37 of the mounting cup 29. The nozzle stem member 44 is normally in the upright (valve closed) configuration illustrated in FIGS. 1 and 2.

A moveable cup member 39 is disposed for axial sliding movements in the region of the central portion 35 of the mount cup 29. The moveable cup member 29 includes a valve plate 51 which transversely (relative to nozzle stem member 44) extends across flange 46. Plate 51 further includes adjacent its outer periphery an integrally formed associated axially upstanding rib portion 52 which annularly extends about the valve plate 51. The rib portion 52, when the valve structure 21 is in its closed configuration as shown in FIG. 2, makes seating engagement with adjacent portions of the gasket 48.

Also, integrally associated with the valve plate 51, are a plurality of radially (relative to plate 51) outwardly extending guide ribs 53 which are configured so as to be equally sized and equally circumferentially spaced from one another, and the radially outer edges of each rib 53 are in a spaced, adjacent, or even optionally contacting, slidable relationship with respect to adjacent portions of wall 32. In the embodiment shown, the guide ribs 53 extend axially downwardly (towards chamber 34) and rearwardly away from the valve plate 51 to an extent sufficient to stabilize sliding movements of the moveable cup member 49 relative to the mounting cup 29 and prevent cocking of the valve plate 51.

Similarly downwardly and rearwardly extends a circumferentially continuous apron 55 integrally from the valve plate 51 in a radially inwardly spaced relationship relative to the outer edges of the ribs 53. The principal purpose of this apron 55 is to provide support and a point of attachment for the adjacent radially inner terminal portions of individual ribs 53, thereby to provide a reinforcing means for the ribs 53 and the plate 51 in the moveable cup member 49.

The assembled combination of valve 21 and container 20 is adapted for the receipt and storage of either a conventionally pressurized (e.g. about 35 to 40 pounds per square inch) fill or of a highly pressurized (e.g. about 150 psi) fill. When valve 21 is unsealed by the removal of seal 36, as described the valve 21 can be operated normally through tilting of stem 44. In such valve open configuration, the pressurized contents in the container 20 flow into the interior region of stem 44 through the passageways existing between circumferentially adjacent ribs 53 and radially adjacent portions of wall 32 and apron 55 and out through orifice 45. As those skilled in the art will appreciate, the valve structure 21 in its open configuration provides a cross-sectionally exceedingly large flow capacity therethrough. Valve structure 21 is well adapted for the dispensing of viscous fluids. When closure of valve structure 21 is desired, the tip end 60 is allowed to return to its normally upright configuration which effects a reversal of the valve opening operations described above and results in a resealing between the rib portion 52 and the gasket 48, with resealing being effectuated, in the valve structure 21, by the interior pressure within the container 20.

Thus, it will be appreciated by those skilled in the art that the seal 36 provides hermetic gas-tight tamperproof isolation of the fill in a chamber 34 or an assembly of container 20 and valve 21, yet the seal 36 does not interfere with the assembly of valve 21 to container 20.

One advantage of the valve structure 21 is that it can be preassembled with the external seal 36 and bonding means 38. The preassembled valve can be stored and then assembled into a container 20 with the operation being conducted without disturbing the seal 36 or the bonding means 38.

Figure 3:
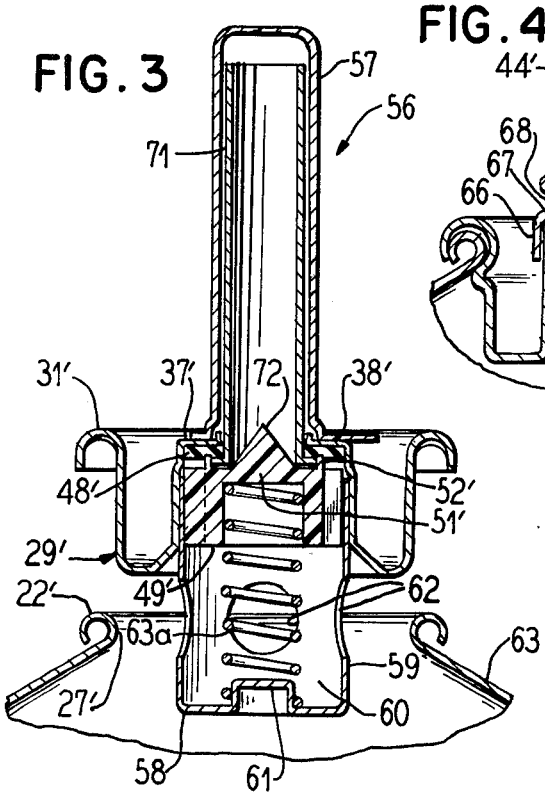
FIG. 3 is a view similar to FIG. 2, but illustrating an alternative embodiment of a preassemblable valve structure of the present invention ready for installation in a container (shown fragmentarily)

Referring to FIG. 3, there is seen a valve assembly 56 which is provided with an initially integrally associated external sealing member 57. Sealing member 57 is secured to a central flagned portion 37′ of a mounting cup 29′ by means of a frangible bonding means 38′.

A bridge support member 58 which is here represented by a cup-shaped embodiment that is preferably formed of sheet metal is employed whose side wall portions 59 are frictionally engaged with adjacent side wall portions 32′ of cup 29′, thereby affixing the position of the bridge support 58 relative to the mounting cup 29′. Thus, the inner, cross-sectionally, generally circular wall surfaces of a central cavity 60 are defined. Alternatively, in place of a frictional engagement between the side walls as indicated, one can employ any convenient conventional securing means including an adhesive or the like as desired.

The bottom or central portion 61 of the bridge support 58 is configured in the form of a plate having an upstanding central portion 61. Open areas 62 are defined in circumferential side wall portions 59 of bridge support 58. The open areas 62 provide apertures through which the fill contents being dispensed from a pressurized container 63 subsequently to be associated with the valve assembly 56 can pass when such valve structure is in an opened configuration with the external seal removed. A coiled compression spring member 63A is received over upstanding central portion 61 at one end thereof while the opposed end of spring member 63A is received against the valve plate 51′ of the moveable cup 49′. The function of the spring 63A is to yieldingly maintain the valve structure 56 in a normally closed configuration wherein the nozzle stem member 71 is in the upright configuration depicted in FIG. 3. The spring 63A thus insures achievement of an adequate seal between the rib portion 52′ and the gasket 48′. The moveable cup member 49′ here utilizes an integral camming member 72 which is conically configured. The effect of the camming member 72 is to magnify the extent of downward travel of the moveable cup member 49′ to an unexpected and surprising extent during valve opening thereby to increase in a highly desirable manner the opening formed between rib portions 52′ and gasket 48′ when the valve stem 71 is in its tilted configuration. Arrangements of this type are shown and described in my copending application U.S. Ser. No. 432,298, filed Oct. 1, 1982 the disclosure and contents of which are incorporated hereinto be reference.

The preassembled valve with associated external sealing member as shown in FIG. 3 is shown being assembled to the top of a container 63. Thus, the rolled perimeter of cup 29′ is nestably received over the rolled perimeter about the mouth or aperture 27′ of container 63. Collet fingers subsequently are employed to crimp the cup 29′ thereby to effectuate an assembly similar to that shown in FIG. 2.

Figure 4:
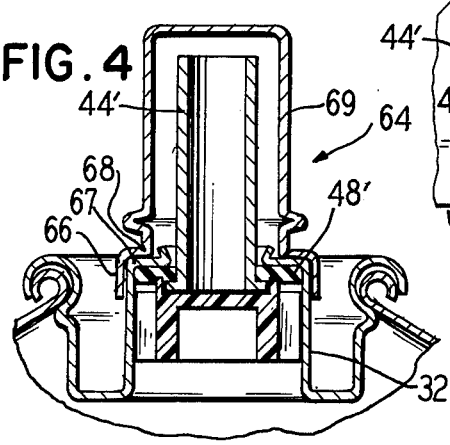
FIG. 4 is a view similar to FIG. 2, but illustrating an alternative embodiment of a valve structure of the present invention.

Referring to FIG. 4, there is seen another embodiment of a valve structure of the present invention which is herein designated in its entirety by the numeral 64. Valve structure 64 is similar to valve structure 21 and corresponding components thereof are similarly numbered but with the addition of prime marks thereto.

In place of seal 36, valve structure 64 employs a cup-shaped seal 69 which may be formed of sheet metal and seal 65 includes a terminal downturned peripheral flange 66 which is adapted to engage inner wall members 32′. Such flanged portions 66 are securely bonded to adjacent portions of the valve body 29′ with a non-releasing bonding means 67 which can be as above described. Here a frangible zone is provided by a coined pathway 68 formed in the juncture between flange 66 and upper portions 68 formed in the juncture between flange 66 and upper portions 69 of the seal 65. The coining defined a weakened or frangible area which is rupturable through the application of tilting force applied to upper portions 69 as in the direction of arrow 70, or the like, as desired. As soon as localized rupture is achieved in the coined area, additional pulling action with appropriate force can be employed to complete separation of upper portions 69 from flange 66, thereby permitting complete removal of the upper portions 69.

Figure 5:
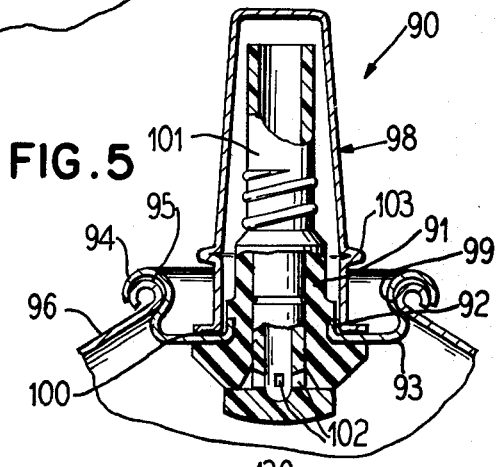
FIG. 5 is a view similar to FIG. 2, but illustrating an alternative embodiment of a valve structure of the present invention.

Referring to FIG. 5, there is seen another type of valve assembly (compared to the valve assembly types shown in the proceeding FIGS. 1–4) which valve assembly is designated in its entirety by the numeral 90. The valve assembly 90 incorporates a conventional type of elastomeric, resilient tubular sealing plug 91 which extends through an aperture 92 centrally formed in a metallic cup-like valve body 93. The peripheral edge regions of the valve body 93 are formed into a rolled lip 94 whose interior surface portions are provided with an elastomeric sealing layer 95 so that the rolled lip 94 can be conventionally mounted over mating portions across the mouth 99 of a dispensing container 96 with collet fingers (not shown).

A seal 98 is fitted over externally exposed components of the valve assembly 90 associated with valve body 93 and the rim portions of the seal 98 are releasably bonded in gas-tight relationship to adjacent portions of the body 93 by rupturable gas-tight bonding means 100, the bonding means 100 in composition being, for example, an organic or inorganic adhesive composition, or the like, as desired, and as above indicated.

In normal (unsealed) operation of valve assembly 90, when the stem 101 of the valve assembly 90 is tilted, the sealing plug 91 is distorted and the access ports 102 formed in the lower portions of the valve stem 101 are exposed, thereby permitting a fill within a container 96 to enter ports 102 and to be dispensed through the hollow interior of stem 101.

To accomplish unsealing of valve 90, a force is transversely applied to the upper end of the seal 98 which is sufficient to break the bonding means 100 between the rim portions of the sealing plate 98 and the valve body 93 resulting in the separation of the seal 98 from the valve body 93.

Alternatively, a pry instrument, such as screw driver or the like (not shown), can be levered against a projection 103 formed in seal 98 to separate the seal 98 from the valve body 93 in the region of bonding means 100.

Figure 6:
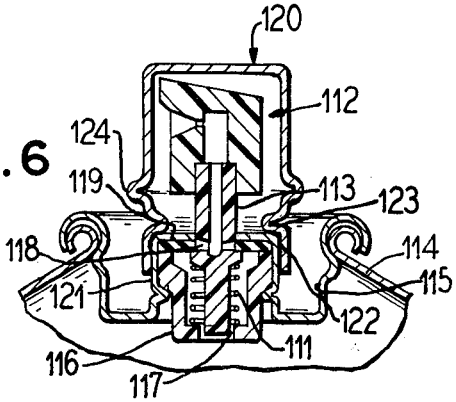
FIG. 6 is a view similar to FIG. 2, but illustrating an alternative embodiment of a valve structure of the present invention.

Referring to FIG. 6, there is seen another type of valve assembly which valve assembly is herein designated in its entirety by the number 112. Valve assembly 112 is of the type wherein, when the valve stem assembly 113 thereof is vertically depressed against principally the yielding bias of a spring 111, there is opened a flow path for a pressurized fill being dispensed from a container 114 with which the cup 115 of the valve 112 is attached through valve body 116 from fill entry port 117 to a plurality of exposed access ports 118 in valve stem assembly 113, the sealing gasket 119 normally covering the ports 118 when the valve assembly 112 is in its closed configuration, as shown. By the present invention, valve assembly 112 is provided with an external seal 120 having a tubular configuration which is releasably bonded to an upstanding central portion 121 of mounting cup 115 by a frangible means 122 which initially secures internal peripheral portions of a crimp 123 to adjacent portions of central portion 121. The exterior seal 120 is provided an intergral projecting pry rib 124 which, when acted upon by a screw driver or the like causes a separation of crimp 123 from the central portion 121 by fracturing the bonding means 122.

Figure 7:
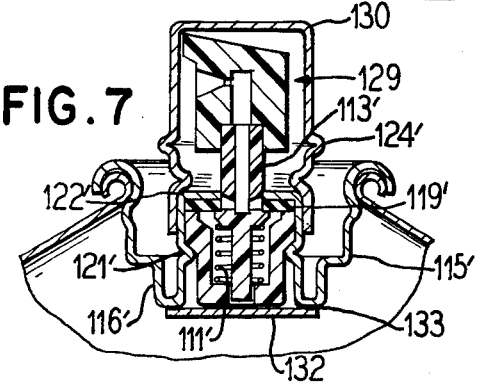
FIG. 7 is a view similar to FIG. 2, but illustrating an alternative embodiment of a valve structure of the present invention.

Referring to FIG. 7, there is seen a valve assembly 129 which is similar to the valve assembly 112 and components of valve assembly 129 are similarly numbered but with the addition of prime marks thereto. The valve assembly 129 is provided with an external seal 130 which is similar structurally to seal 120 and releasably bonded to the upstanding central portion 121' of the cup 115' by a releasable bonding means 122' which initially secures the peripheral portions of the seal 130 to adjacent portions of the central portion 121'.

Valve assembly 129 is additionally provided with an internal seal 132 which is hermetically sealed to cup 115' by bonding means 133. Initial downward movement of valve stem assembly 113' after the external seal 130 is opened results in sufficient pressure being applied aqainst internal seal 132 to rupture the bonding means 133 and thereby permit a normal operation of valve assembly 129 to take place for fill dispensing operations.

The use of a combination of internal and external seals in a valve assembly of this invention can be advantageous when a fill of high purity, a fill which is readily contaminated by atmospheric gases or a use environment, a fill of great reactivity or poor storage capability, or the like, is involved. The internal/external seal combination permits storing before use of a fill to be dispensed from an aerosol container or the like in a sterile environment under sealed conditions.

Figure 8:
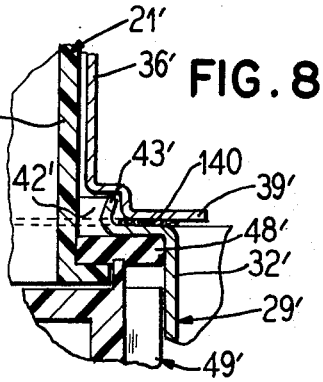
FIG. 8 is a fragmentary section illustrating a further embodiment of the present invention.

Referring to FIG. 8, there is seen an embodiment of the invention similar to that shown in FIG. 2 except that here the bonding means 140 is a circular strip of double-faced pressure sensitive adhesive tape wherein each exposed surface of such tap 140 is provided with a permanently tacky self-sticking adhesive layer, each such layer being adapted for form in contact with a metal surface a hermetic seal. One advantage of using such a tape 140 is that it permits a seal 36' to be removed, as by leveraged pressure upon a tab 39' applied by a screw driver or the like (not shown) and then replaced after a free dispensing operation from container (not shown) through valve assembly 21' thereby to accomplish a reestablishment of a hermetic seal over the valve cup or body 29'. Thus, the only air left adjacent the valve stem 44' is that held within the chamber defined by valve body 29', seal 36, and tape 140.

One presently preferred class of valve for use in the practice of the present invention comprises valves having tiltable stem in combination with a moveable cup, particularly such valves of this type which have a high flow capacity such as are shown in FIGS. 1 through 4 and described herein. For additional valves of this general type, see the teachings of my copending U.S. patent application Ser. No. 394,517 filed July 2, 1982; U.S. patent application Ser. No. 405,696 filed Aug. 5, 1982; U.S. patent application Ser. No. 432,298 filed Oct. 1, 1982; and U.S. patent application Ser. No. 438,212 filed Nov. 1, 1982; the disclosure of each of which is entirely incorporated hereinto by reference.

Although the teachings of my invention have herein been discussed with reference to specific embodiments, it is to be understood that these are by way of illustration only and that others may wish to utilize my invention in different designs or applications.

I claim:

1. A preassemblable fluid dispensing valve structure for dispensing the fill contents of a pressurizable container comprising:

a valve mounting cup having wall portions defining (a) a perimeter region which is peripherally sealingly securable to said pressurizable container, (b) a central valve receiving chamber with an upper aperture and longitudinally spaced lower aperture means defined therein, and (c) a cavity extending between said valve receiving chamber and said perimeter region and adapted for receipt thereinto of crimp forming means;

an elongated tubular nozzle means having a dispensing orifice in one end thereof and having a second receiving end extending through said upper aperture;

resilient valve seat means positioned generally in said valve receiving chamber;

a moveable valve means biasable against said valve seat means to close said valve structure;

said tubular nozzle means being moveable from a normally valve closed position relative to said valve mounting cup and having said second end thereof adapted for unseating said moveable valve means to open said valve structure when said tubular nozzle means is moved;

a gas-tight sealing member having a central region which is positioned over said tubular nozzle means and having peripheral portions positioned in adjacent relationship to said wall portions defining said valve receiving chamber, said peripheral portion being radially generally inwardly adjacent said cavity;

a gas-tight sealing means securing said peripheral portions to said adjacent wall portions;

a frangible zone extending in a closed pathway generally adjacent to said valve receiving chamber and defined in at least one of said sealing member and said sealing means, said frangible zone being rupturable in response to applied localized external force, whereby said central region is removable from said tubular nozzle means, and whereby thereafter said contents are dispensable when said tubular nozzle means is so moved.

2. The dispensing valve structure of claim 1 wherein said frangible zone is defined by said sealing means.

3. The dispensing valve structure of claim 1 wherein said sealing member is comprised of sheet metal.

4. The dispensing valve structure of claim 1 wherein said gas tight sealing means comprises an adhesive composition.

5. The dispensing valve structure of claim 1 wherein said resilient valve seat means comprises an elastomeric tubular plug member which extends through said upper aperture circumferentially about said tubular nozzle means, and wherein said tubular nozzle means is associated with said moveable valve means whereby, when said one end of said tubular nozzle means is tilted relative to said valve mounting cup, said tubular plug member means exposes aperture mean in said moveable valve means, thereby to permit flow of said contents through said tubular nozzle means.

6. The dispensing valve structure of claim 1 wherein said resilient valve seat means comprises gasket means circumferentially disposed about said tubular nozzle means, said tubular means is integrally associated with said moveable valve means, and said tubular nozzle means is longitudinally reciprocable whereby, when said one end of said tubular nozzle is depressed towards said valve mounting cup, and aperture means are exposed in said moveable valves means, thereby to permit flow of said contents through said tubular nozzle means.

7. The dispensing valve structure of claim 1 wherein said peripheral portions are positioned in radially outer adjacent relationship to said valve receiving chamber.

8. A device for dispensing a highly viscous liquid comprising:

(A) a pressurizable container, and (B) a fluid dispensing valve structure of claim 1 functionally associated therewith.

9. The dispensing valve structure of claim 1 wherein said sealing member has tab means associated therewith for applying an external force against said sealing member to rupture said frangible zone.

10. The dispensing valve structure of claim 1 wherein said gas tight sealing means comprises a metal.

11. The dispensing valve structure of claim 10 wherein said metal is a weld.

12. The dispensing valve structure of claim 10 wherein said metal is a solder.

13. The dispensing device of claim 1 wherein said moveable valve means comprises a moveable cup that is slidably longitudinally reciprocal within portions of said valve receiving chamber responsively to tilting movement of said one end and wherein said resilient valve seat means comprises a gasket circumferentially sealingly disposed about said upper aperture in said valve receiving chamber and also about said second end of said tubular nozzle means whereby, when said one end is tilted relative to said valve mounting cup, said moveable cup is moved by said second end from said gasket, thereby to permit flow of said fill contents through said tubular nozzle means.

14. The dispensing valve structure of claim 13 wherein camming means is associated with said moveable cup for accelerating movement of said cup by said tubular nozzle means during valve opening.

15. A preassemblable fluid dispensing valve structure for dispensing the fill contents of a pressurizable container comprising:

a valve mounting cup having wall portions defining (a) a perimeter region which is peripherally sealingly securable to said pressurizable container, (b) a central valve receiving chamber with an upper aperture and longitudinally spaced lower aperture means defined therein, and (c) a cavity extending between said valve receiving chamber and said perimeter region and adapted for receipt thereinto of crimp forming means;

an elongated tubular nozzle means having a dispensing orifice in one end thereof and having a second receiving end extending through said upper aperture;

resilient valve seat means positioned generally in said valve receiving chamber;

a moveable valve means biasable against said valve seat means to close said valve structure;

said tubular nozzle means being moveable from a normally valve closed position relative to said valve mounting cup and having said second end thereof adapted for unseating said moveable valve means to open said valve structure when said tubular nozzle means is moved;

a gas-tight sealing member comprised of sheet metal having a central region which is positioned over said tubular nozzle means and having peripheral portions positioned in adjacent relationship to said wall portions defining said valve receiving chamber, said peripheral portions being radially generally inwardly adjacent said cavity;

a gas-tight sealing means securing said peripheral portions to said adjacent wall portions;

a frangible zone extending in a closed pathway generally adjacent to said valve receiving chamber and defined in at least one of said sealing member and said sealing means, said frangible zone being rupturable in response to applied localized external force, whereby said central region is removable from said tubular nozzle means, and whereby thereafter said contents are dispensable when said tubular nozzle means is so moved, and wherein said frangible zone is defined by a coined region.

16. A preassemblable fluid dispensing valve structure for dispensing the fill contents of a pressurizable container comprising:

a valve mounting cup having wall portions defining (a) a perimeter region which is peripherally sealingly securable to said pressurizable container, (b) a central valve receiving chamber with an upper aperture and longitudinally spaced lower aperture means defined therein, and (c) a cavity extending between said valve receiving chamber and said perimeter region and adapted for receipt thereinto of crimp forming means;

an elongated tubular nozzle means having a dispensing orifice in one end thereof and having a second receiving end extending through said upper aperture;

resilient valve seat means positioned generally in said valve receiving chamber;

a moveable valve means biasable against said valve seat means to close said valve structure;

said tubular nozzle means being moveable from a normally valve closed position relative to said valve mounting cup and having said second end thereof adapted for unseating said moveable valve means to open said valve structure when said tubular nozzle means is moved;

a gas-tight sealing member having a central region which is positioned over said tubular nozzle means and having peripheral portions positioned in adjacent relationship to said wall portions defining said valve receiving chamber, said peripheral portions being radially generally inwardly adjacent said cavity;

a gas-tight sealing means securing said peripheral portions to said adjacent wall portions;

a frangible zone extending in a closed pathway generally adjacent to said valve receiving chamber and defined in at least one of said sealing member and said sealing means, said frangible zone being rupturable in response to applied localized external force, whereby said central region is removable from said tubular nozzle means, and whereby thereafter said contents are dispensable when said tubular nozzle means is so moved; and an internal sealing means which seals said lower aperture means, which is peripherally sealingly engaged with said wall portions, and which is separatable therefrom by movement of said tubular nozzle means after said frangible zone has been ruptured and said central region has been removed.

* * * * *